US011064850B2

(12) United States Patent
Wu et al.

(10) Patent No.: US 11,064,850 B2
(45) Date of Patent: Jul. 20, 2021

(54) TOILET SEAT ASSEMBLY INSTALLATION STRUCTURE CONVENIENT FOR DISASSEMBLY AND ASSEMBLY

(71) Applicant: XIAMEN R&T PLUMBING TECHNOLOGY CO., LTD., Fujian (CN)

(72) Inventors: Jiebin Wu, Fujian (CN); Xiaomeng Lin, Fujian (CN); Weiquan Xie, Fujian (CN)

(73) Assignee: XIAMEN R&T PLUMBING TECHNOLOGY CO., LTD, Xiamen (CN)

( * ) Notice: Subject to any disclaimer, the term of this patent is extended or adjusted under 35 U.S.C. 154(b) by 0 days.

(21) Appl. No.: 16/810,818

(22) Filed: Mar. 5, 2020

(65) Prior Publication Data

US 2021/0068597 A1 Mar. 11, 2021

(30) Foreign Application Priority Data

Sep. 10, 2019 (CN) ..... 201921503126.5

(51) Int. Cl.
*A47K 13/12* (2006.01)
*A47K 13/26* (2006.01)

(52) U.S. Cl.
CPC ..... *A47K 13/12* (2013.01); *A47K 13/26* (2013.01)

(58) Field of Classification Search
CPC ..... A47K 13/12; A47K 13/26
USPC ..... 4/240
See application file for complete search history.

(56) References Cited

U.S. PATENT DOCUMENTS 9,986,878 B2 * 6/2018 Stelter ..... A47K 13/26
2009/0000017 A1 * 1/2009 Zhou ..... A47K 13/12 4/236
2009/0276944 A1 * 11/2009 Hand ..... A47K 13/26 4/240

* cited by examiner

*Primary Examiner* — Christine J Skubinna
(74) *Attorney, Agent, or Firm* — Demian K. Jackson; Jackson IPG PLLC

(57) ABSTRACT

The disclosure discloses a toilet seat assembly installation structure convenient for disassembly and assembly, which comprises fixing members fixedly installed on a toilet seat; a hinge base including hinge portions and installation portions, the hinge portions hinging with a cover plate, the installation portions engaging with the fixing members; and snap-in connection members configured to detachably and position-limitedly installed on the installation portions along a vertical direction so that the snap-in connection members are fixedly engaged with the fixing members, or to detachably and position-limitedly installed on the fixing members along the vertical direction so that the snap-in connection members are fixedly engaged with the installation portions. The toilet seat assembly installation structure is easy to operate, can be dissembled and assembled by inserting/removing the hinge base into/from the fixing members, and is stable and reliable.

10 Claims, 5 Drawing Sheets

TOILET SEAT ASSEMBLY INSTALLATION STRUCTURE CONVENIENT FOR DISASSEMBLY AND ASSEMBLY

CROSS REFERENCE TO RELATED APPLICATIONS

The present application claims the benefit of Chinese Patent Application No. 201921503126.5 filed on Sep. 10, 2019, the contents of which are incorporated herein by reference in their entirety.

FIELD OF THE APPLICATION

The disclosure relates to a toilet seat assembly installation structure convenient for disassembly and assembly.

BACKGROUND OF THE APPLICATION

The traditional toilet seat assembly installation structure is usually in an inserted structure which includes: a fixing base fixedly installed on a toilet seat, the fixing base being provided with outward projections at two sides of the fixing base; and a hinge base including a bottom cover, the bottom cover being provided with indentations which correspond to the outward projections and are engaged with the outward projection so that assembly and disassembly of the hinge base is achieved by horizontally pushing the bottom cover. When the structure is to be installed, the hinge base needs to be aligned with the outward projections and the indentations on the two sides. However, since the indentations are hidden inside the bottom cover, it is difficult to observe for users in installing, and the structure may not be installed in place, so that the cover plate cannot be fixed, thereby causing a certain safety hazard when the structure is used by users. Further, after the cover plate is used for a long time, dust is easy to accumulate in the indentations, resulting in a jamming phenomenon between the indentations and the outward projections, which is not convenient for users to disassemble.

SUMMARY OF THE APPLICATION

In order to solve the aforementioned problem, an objective of the disclosure is to provide a toilet seat assembly installation structure convenient for disassembly and assembly.

In order to achieve the aforementioned objective, the disclosure provides a toilet seat assembly installation structure convenient for disassembly and assembly comprising:

a fixing member fixedly installed on a toilet seat;

a hinge base including a hinge portion and an installation portion, the hinge portion being used for rotary connection with a cover plate, and the installation portion being engaged with the fixing member; and a snap-in connection member configured to detachably and position-limitedly installed on the installation portion along a vertical direction so that the snap-in connection member is fixedly engaged with the fixing member through snap-in connection, or configured to detachably and position-limitedly installed on the fixing member along the vertical direction so that the snap-in connection member is fixedly engaged with the installation portion through snap-in connection.

Preferably, the snap-in connection member is installed on the installation portion, and the toilet seat assembly installation structure convenient for disassembly and assembly further comprises a first position-limiting member detachably and fixedly installed on the installation portion, which plays a position-limiting role to the snap-in connection member in the vertical direction.

Preferably, the first position-limiting member is engaged with the installation portion through snap-in connection, or the first position-limiting member is engaged with the installation portion through thread connection.

Preferably, the toilet seat assembly installation structure convenient for disassembly and assembly further comprises a second position-limiting member which plays a position-limiting role to the snap-in connection member so that snap-in connection between the snap-in connection member and the fixing member or the installation portion is maintained.

Preferably, the snap-in connection member is installed on the installation portion which is provided with a movable buckle cover, the second position-limiting member is a locking block provided on the buckle cover. The buckle cover moves to drive the locking block to insert into the installation portion or withdraw from the installation portion. When the locking block is inserted into the installation portion, the locking block plays a position-limiting role to the snap-in connection member, thereby maintaining the snap-in connection between the snap-in connection member and the fixing member.

Preferably, the snap-in connection member is provided with rotation-preventing grooves, and the installation portion or the fixing member is provided with rotation-preventing ribs which correspond to and are engaged with the rotation-preventing grooves to limit movement of the snap-in connection member in a circumferential direction.

Preferably, the fixing member or the installation portion is provided with a ring groove in a circumferential direction, the snap-in connection member is engaged with the ring groove through snap-in connection, and the snap-in connection member is a C-shaped buckle.

Preferably, the installation portion is provided with a sleeve hole which is vertically sleeved with the fixing member.

Preferably, the installation portion is provided with an accommodating cavity in which the snap-in connection member is provided, and the sleeve hole is arranged in a bottom of the accommodating cavity and communicates with the accommodating cavity.

Preferably, the hinge portion is a shaft sleeve, and there are two installation portions respectively arranged on both ends of the shaft sleeve along an axial direction of the shaft sleeve.

The technical solution of the disclosure has the following beneficial effects, compared with the prior art:

1. In the toilet seat assembly installation structure convenient for disassembly and assembly provided in the disclosure, the fixing member is fixedly installed on a toilet seat; the hinge base includes a hinge portion and an installation portion, wherein the hinge portion is used for rotary connection with a cover plate and the installation portion is engaged with the fixing member; and the snap-in connection member is configured to detachably and position-limitedly installed on the installation portion along a vertical direction so that the snap-in connection member is fixedly engaged with the fixing member, or is configured to detachably and position-limitedly installed on the fixing member along the vertical direction so that the snap-in connection member is fixedly engaged with the installation portion. The toilet seat assembly installation structure is easy to operate, can be dissembled and assembled by inserting/removing the hinge base into/from the fixing members, and is stable and reliable. The snap-in connection members are formed separately, which can simplify the production process of the fixing members or the hinge base. When a snap-in connection member is aged or damaged, only the snap-in connection member would be replaced without replacing an entire fixing member or hinge base, therefore, the operation is convenient and the cost is saved.

2. The snap-in connection member is installed on the installation portion, and the toilet seat assembly installation structure convenient for disassembly and assembly further comprises a first position-limiting member detachably and fixedly installed on the installation portion, which plays a position-limiting role to the snap-in connection member in the vertical direction. It is easy for product molding and product assembly.

3. The toilet seat assembly installation structure convenient for disassembly and assembly further comprises a second position-limiting member which plays a position-limiting role to the snap-in connection member so that snap-in connection between the snap-in connection member and the fixing member or the installation portion is maintained. The stable structure prevents the snap-in connection member from being separated from the fixing member or the installation portion.

4. The snap-in connection member is installed on the installation portion which is provided with a movable buckle cover, the second position-limiting member is a locking block provided on the buckle cover, the buckle cover moves to drive the locking block to insert into the installation portion or withdraw from the installation portion; when the locking block is inserted into the installation portion, the locking block plays a position-limiting role to the snap-in connection member, thereby maintaining the snap-in connection between the snap-in connection member and the fixing member. The buckle cover plays the role of dust prevention, and it is convenient for users to disassemble and disassemble, and the hinge base can be pulled out by opening the buckle cover.

BRIEF DESCRIPTION OF THE DRAWINGS

The drawings described here are used to provide a further understanding of the disclosure and constitute a part of the disclosure. The exemplary embodiments and description of the disclosure are intended to explain the disclosure, and do not constitute an improper limitation of the disclosure. In the drawings.

DETAILED DESCRIPTION OF PREFERRED EMBODIMENTS

Figure 1:
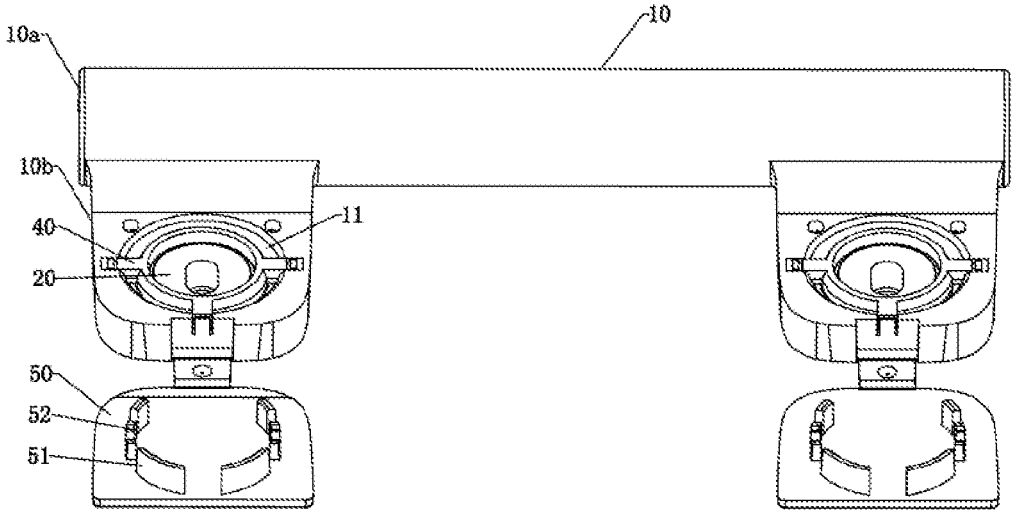
FIG. 1 is a perspective view of a cover installation structure convenient for disassembly and assembly according to the first embodiment of the disclosure.
Figure 2:
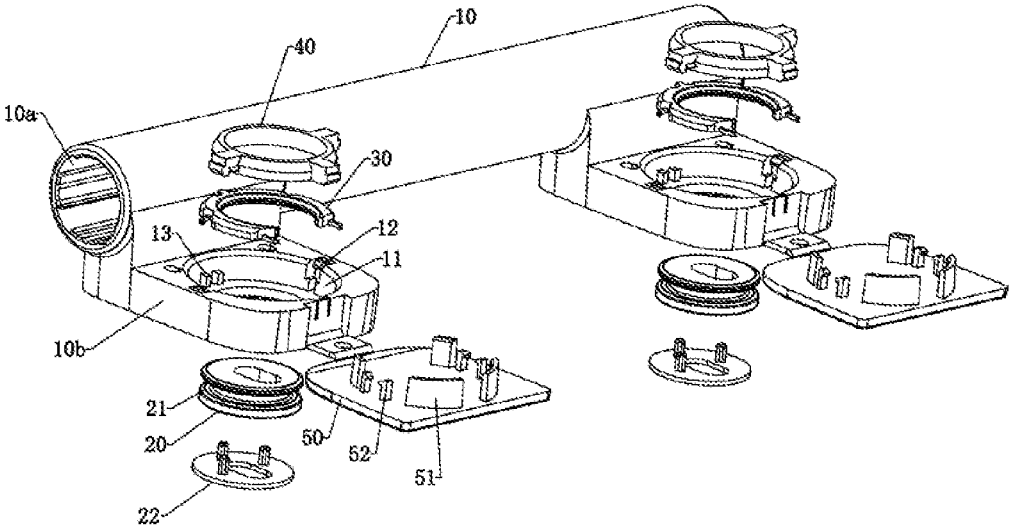
FIG. 2 is an exploded view of a toilet seat assembly installation structure convenient for disassembly and assembly according to the first embodiment of the disclosure.
Figure 3:
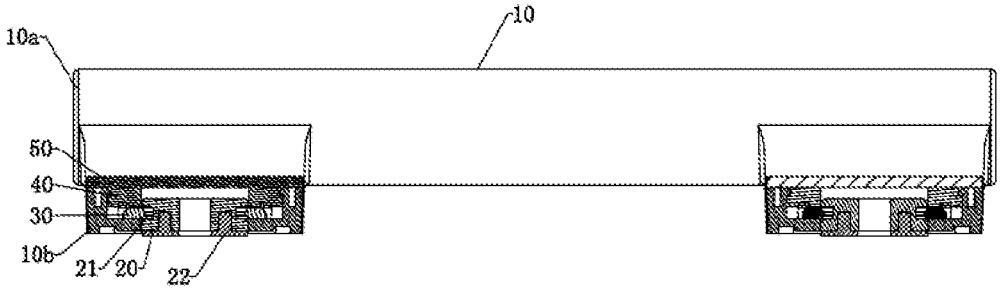
FIG. 3 is a cross-sectional view of a toilet seat assembly installation structure convenient for disassembly and assembly according to the first embodiment of the disclosure.
Figure 4:
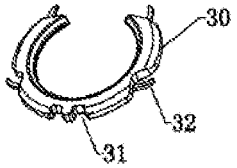
FIG. 4 is a perspective view of a snap-in connection member of a toilet seat assembly installation structure convenient for disassembly and assembly according to the first embodiment of the disclosure.
Figure 5:
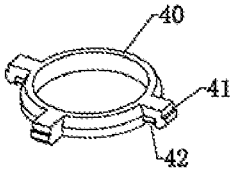
FIG. 5 is a perspective view of a first position-limiting member of a toilet seat assembly installation structure convenient for disassembly and assembly according to the first embodiment of the disclosure.
Figure 6:
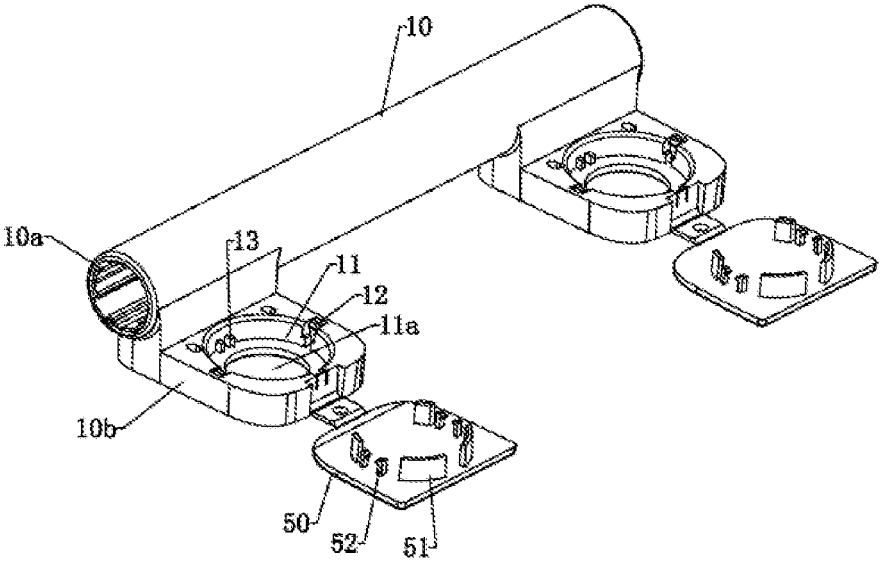
FIG. 6 is a perspective view of a hinge base of a toilet seat assembly installation structure convenient for disassembly and assembly according to the first embodiment of the disclosure.

The specific implementations of the disclosure are further described in detail below with reference to the drawings and embodiments, in order to make the technical problems, technical solutions and beneficial effects to be solved by the disclosure to be more clearly understood. It should be understood that the specific embodiments described herein are only intended to illustrate the disclosure, but are not intended to limit the scope of the disclosure.

Embodiment 1

Refer to FIGS. 1 to 6, a toilet seat assembly installation structure convenient for disassembly and assembly provided in the disclosure comprises: a fixing member 20 fixedly installed on a toilet seat; a hinge base 10 including a hinge portion 10*a* and an installation portion 10*b*, wherein the hinge portion 10*a* is used for rotary connection with a cover plate and the installation portion 10*b* is engaged with the fixing member 20; and a snap-in connection member 30 configured to detachably and position-limitedly installed on the installation portion 10*b* along a vertical direction so that the snap-in connection member 30 is fixedly engaged with the fixing member 20 through snap-in connection, or configured to detachably and position-limitedly installed on the fixing member 20 along the vertical direction so that the snap-in connection member 30 is fixedly engaged with the installation portion 10*b* through snap-in connection.

In the embodiment, the snap-in connection member 30 is installed on the installation portion 10*b*, and the toilet seat assembly installation structure convenient for disassembly and assembly further comprises a first position-limiting member 40 detachably and fixedly installed on the installation portion 10*b*, which plays a position-limiting role to the snap-in connection member 30 in the vertical direction. It is easy for product molding and product assembly.

In the embodiment, the first position-limiting member 40 is engaged with the installation portion 10*b* through snap-in connection. Specifically, the first position-limiting member 40 is provided with a first position-limiting step 41, and the installation portion 10*b* is correspondingly provided with a first buckle 12 which is engaged with the first position-limiting step 41 through snap-in connection.

In other embodiments, the first position-limiting member 40 is engaged with the installation portion 10*b* through thread connection.

In the embodiment, the toilet seat assembly installation structure convenient for disassembly and assembly further comprises a second position-limiting member which plays a position-limiting role to the snap-in connection member 30 so that the snap-in connection between the snap-in connection member 30 and the fixing member 20 is maintained. The stable structure prevents the snap-in connection member 30 from being separated from the fixing member 20 or the installation portion 10*b*.

In the embodiment, the installation portion 10*b* is provided with a movable buckle cover 50, the second position-limiting member is a locking block 51 provided on the buckle cover 50, the buckle cover 50 moves to drive the locking block 51 to insert into the installation portion 10*b* or withdraw from the installation portion 10*b*. When the locking block 51 is inserted into the installation portion 10*b*, the locking block 51 plays a position-limiting role to the snap-in connection member 30, thereby maintaining the snap-in connection between the snap-in connection member 30 and the fixing member 20. Specifically, the buckle cover 50 is pivotally connected to the installation portion 10*b*, the buckle cover 50 is further provided with a second buckle 52, and the first position-limiting member 40 is provided with a second position-limiting step 42 which is engaged with the second buckle 52 through snap-in connection. The buckle cover 50 can play a role of dust prevention, meanwhile it is convenient for users to disassemble and disassemble, and the hinge base 10 can be pulled out by opening the buckle cover 50.

In the embodiment, the snap-in connection member 30 is provided with rotation-preventing grooves 31, and the installation portion 10*b* or the fixing member 20 is provided with rotation-preventing ribs 13 which correspond to and are engaged with the rotation-preventing grooves 31 to limit movement of the snap-in connection member 30 in a circumferential direction.

In the embodiment, the fixing member 20 or the installation portion 10*b* is provided with a ring groove 21 in a circumferential direction, the snap-in connection member 30 is engaged with the ring groove 21 through snap-inconnection. Specifically, the fixing member 20 is fixedly installed on the toilet seat through a bolt set, and a bottom of the fixing member 20 is provided with a non-slip rubber pad 22.

In the embodiment, the snap-in connection member 30 is a C-shaped buckle. The outer wall of the C-shaped buckle is further provided with a plurality of positioning ribs 32 that abut on the installation portion 10*b*. The positioning ribs 32 are elastic ribs.

In the embodiment, the installation portion 10*b* is provided with a sleeve hole 11*a* which is vertically sleeved with the fixing member 20.

In the embodiment, the installation portion 10*b* is provided with an accommodating cavity 11 in which the snap-in connection member 30 is provided, and the sleeve hole 11*a* is arranged in a bottom of the accommodating cavity 11 and communicates with the accommodating cavity 11.

In the embodiment, the hinge portion 10*a* is a shaft sleeve, and there are two installation portions 10*b* respectively arranged on both ends of the shaft sleeve along an axial direction of the shaft sleeve.

In other embodiments, the snap-in connection member 30 is installed on the fixing member 20. Correspondingly, the fixing member 20 is provided with rotation-preventing ribs 13 which correspond to and are engaged with the rotation-preventing grooves 31 to limit movement of the snap-in connection member 30 in the circumferential direction. The installation portion 10*b* is provided with a ring groove 21 along the circumferential direction. When the second position-limiting member plays a position-limiting role to the snap-in connection member 30, the snap-in connection between the snap-in connection member 30 and the installation portion 10*b* can be maintained.

The specific operating process of the embodiment is shown as follows:

In the process of assembly, the fixing member 20 is first fixedly locked on the toilet seat. The installation portion 10*b* of the hinge base 10 is aligned to the position of the fixing member 20 and is inserted vertically, so that the fixing member 20 extends through the sleeve hole 11*a* and enters the accommodating cavity 11 to engage with the snap-in connection member 30. The buckle cover 50 is closed to drive the locking block 51 to be inserted into the accommodating cavity 11 of the installation portion 10*b*, thereby playing a position-limiting to the snap-in connection member 30, so that the snap-in connection member 30 is locked with the fixing member 20 through snap-in connection, and then the installation of the cover plate is completed.

In the process of disassembly, the buckle cover 50 is opened to drive the locking block 51 remove from the accommodating cavity 11 of the installation portion 10*b*, thereby releasing the position-limiting role to the snap-in connection member 30; the hinge base 10 is pulled out vertically so that the hinge base 10 separates from the fixing member 20, and then the disassembly of the cover plate is completed.

The toilet seat assembly installation structure is easy to operate, can be dissembled and assembled by inserting the hinge base 10 into the fixing member 20 or removing from the fixing member 20, and is stable and reliable. The snap-in connection member 30 is formed separately, which can simplify the production process of the fixing member 20 or the hinge base 10. When a snap-in connection member 30 is aged or damaged, only the snap-in connection member 30 would be replaced without replacing an entire fixing member 20 or hinge base 10, therefore, the operation is convenient and the cost is saved.

Embodiment 2

Figure 7:
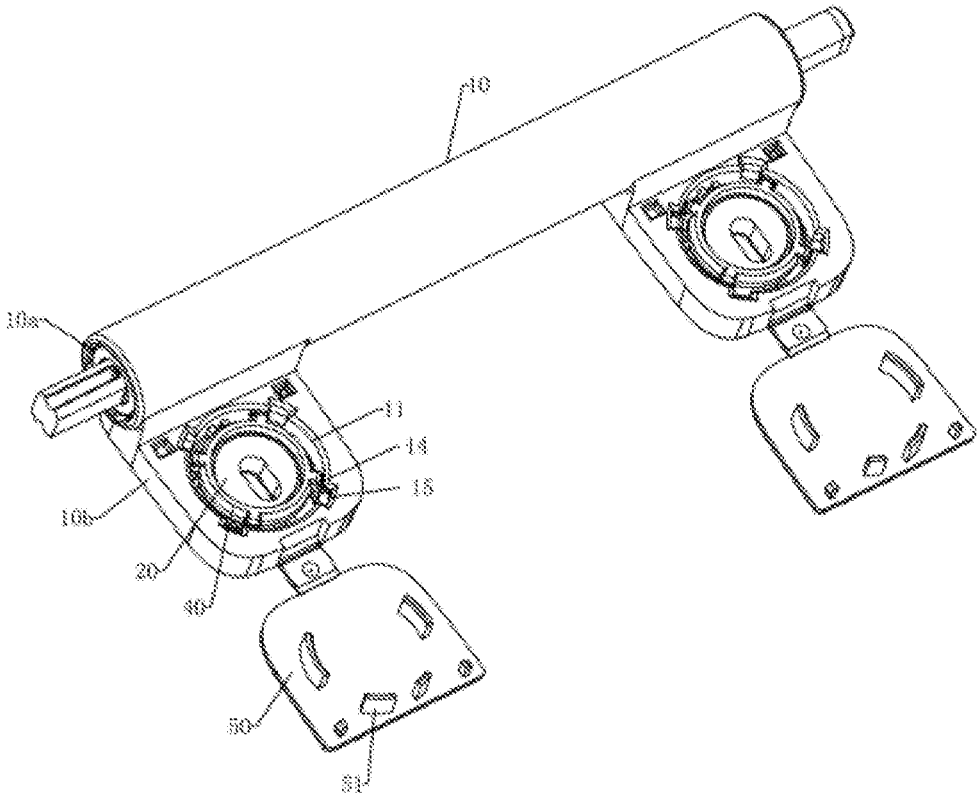
FIG. 7 is a perspective view of a toilet seat assembly installation structure convenient for disassembly and assembly according to the second embodiment of the disclosure.

Refer to FIG. 7, the main difference between this embodiment and the foregoing embodiment is that the first position-limiting member 40 in this embodiment is provided with a first position-limiting step 41, and the installation portion 10*b* is correspondingly provided with a position-limiting groove 14 that cooperates with the first position-limiting step 41 and an avoidance groove 15 that is used for avoiding the first position-limiting step 41. The first position-limiting member 40 drives the first position-limiting step 41 to rotate between the position-limiting groove 14 and the avoidance groove 15, thereby achieving the snap-fitting and avoiding-fitting of the first position-limiting member 40 and the installation portion 10*b*.

Other parts that are not described in this embodiment are the same as that in the foregoing embodiment, and will not be repeated here.

The above description shows and describes the preferred embodiments of the disclosure. As mentioned above, it should be understood that the disclosure is not limited to the forms disclosed herein, and should not be regarded as an exclusion of other embodiments, but can be used in various other combinations, modifications and environments. The embodiments can be modified within the scope of the concept of the disclosure according to the above teachings or related field technology or knowledge. Modifications and changes made by those skilled in the art without departing from the spirit and scope of the disclosure should all fall within the protection scope of the appended claims of the disclosure.

What is claimed is:

1. A toilet seat assembly installation structure convenient for disassembly and assembly, wherein the toilet seat assembly installation structure convenient for disassembly and assembly comprises:

a fixing member fixedly installed on a toilet base;

a hinge base including a hinge portion and an installation portion, the hinge portion being used for rotary connection with a cover plate, and the installation portion being engaged with the fixing member; and a snap-in connection member configured to detachably and position-limitedly installed on the installation portion along a vertical direction, and the snap-in connection member is fixedly engaged with the fixing member through snap-in connection, or, the snap-in connection member configured to detachably and position-limitedly installed on the fixing member along the vertical direction, and the snap-in connection member is fixedly engaged with the installation portion through snap-in connection.

2. The toilet seat assembly installation structure convenient for disassembly and assembly of claim 1, wherein the snap-in connection member is installed on the installation portion, and the toilet seat assembly installation structure convenient for disassembly and assembly further comprises a first position-limiting member detachably and fixedly installed on the installation portion, which plays a position-limiting role to the snap-in connection member in the vertical direction.

3. The toilet seat assembly installation structure convenient for disassembly and assembly of claim 2, wherein the first position-limiting member is engaged with the installation portion through snap-in connection, or the first position-limiting member is engaged with the installation portion through thread connection.

4. The toilet seat assembly installation structure convenient for disassembly and assembly of claim 1, wherein the toilet seat assembly installation structure convenient for disassembly and assembly further comprises a second position-limiting member which plays a position-limiting role to the snap-in connection member so that snap-in connection between the snap-in connection member and the fixing member or the installation portion is maintained.

5. The toilet seat assembly installation structure convenient for disassembly and assembly of claim 4, wherein the snap-in connection member is installed on the installation portion which is provided with a movable buckle cover, the second position-limiting member is a locking block provided on the buckle cover, the buckle cover moves to drive the locking block to insert into the installation portion or withdraw from the installation portion; when the locking block is inserted into the installation portion, the locking block plays a position-limiting role to the snap-in connection member, thereby maintaining the snap-in connection between the snap-in connection member and the fixing member.

6. The toilet seat assembly installation structure convenient for disassembly and assembly of claim 1, wherein the snap-in connection member is provided with rotation-preventing grooves, and the installation portion or the fixing member is provided with rotation-preventing ribs which correspond to and are engaged with the rotation-preventing grooves to limit relative movement between the rotation-preventing ribs and the rotation-preventing grooves in a circumferential direction.

7. The toilet seat assembly installation structure convenient for disassembly and assembly of claim 1, wherein the fixing member or the installation portion is provided with a ring groove in a circumferential direction, the snap-in connection member is engaged with the ring groove through snap-in connection, and the snap-in connection member is a C-shaped buckle.

8. The toilet seat assembly installation structure convenient for disassembly and assembly of claim 1, wherein the installation portion is provided with a sleeve hole which is vertically sleeved with the fixing member.

9. The toilet seat assembly installation structure convenient for disassembly and assembly of claim 8, wherein the installation portion is provided with an accommodating cavity in which the snap-in connection member is provided, and the sleeve hole is arranged in a bottom of the accommodating cavity and communicates with the accommodating cavity.

10. The toilet seat assembly installation structure convenient for disassembly and assembly of claim 1, wherein the hinge portion is a shaft sleeve, and there are two installation portions respectively arranged on both ends of the shaft sleeve along an axial direction of the shaft sleeve.

* * * * *